US005472288A

United States Patent [19]

Deutsch et al.

[11] Patent Number: 5,472,288

[45] Date of Patent: Dec. 5, 1995

[54] FLIP CHART SHEET RETAINER

[75] Inventors: Dennis Deutsch, Hastings; Jeffrey S. Brower, Marine, both of Minn.

[73] Assignee: Pierce Companies, Inc., Santa Ana, Calif.

[21] Appl. No.: 286,681

[22] Filed: Aug. 5, 1994

[51] Int. Cl.[6] ..... B42F 3/00

[52] U.S. Cl. ..... 402/4; 281/33

[58] Field of Search ..... 281/28, 29, 33, 281/43, 44, 45, 51; 402/4, 70, 73, 80 R; 248/441.1, 451, 452, 453

[56] References Cited

U.S. PATENT DOCUMENTS

| | | | |
|---|---|---|---|
| 1,249,015 | 12/1917 | Brink | 402/4 |
| 1,434,511 | 11/1922 | Swanson | 402/4 |
| 3,638,967 | 2/1972 | Mullins | 281/33 |
| 4,213,520 | 7/1980 | Sarna | 281/33 X |
| 4,253,260 | 3/1981 | Maza et al. | 281/33 X |

*Primary Examiner*—Willmon Fridie, Jr.
*Attorney, Agent, or Firm*—Price, Gess & Ubell

[57] ABSTRACT

A ring-based sheet retainer can be removably attached to a blackboard or a presentation board. At least two sheet retainers are attached to a support member that is an elongate planar member equipped with mechanical fasteners designed to engage a complementary structure on a presentation board or the like. Each sheet retainer comprises an ring and a ring closure. The ring has the form of flattened oval: straight midportions connected by semicircular end portions. There is a gap in the midportion of the ring whereby sheets are inserted into the ring. The ring closure is a straight hollow cylinder sized to slide over the straight midportion of a gaped side of the ring. The closure is attached to the support member with an end overhanging the edge of the support member so as to receive punched sheets when the ring is open. Sliding the ring into the closure opens the ring by revealing the gap at the overhanging end of the closure. A lock bar, perpendicular to a plane of the ring, is attached to an outer edge of the ring at a point where a semicircular region of the ring interacts with the closure when the ring is open. The lock bar contacts the support member and maintains the ring perpendicular to the support member. A lock piece attached to a pivoting ring lock interacts with the lock bar when the ring is closed, thereby preventing the ring from opening until the lock is pivoted.

14 Claims, 3 Drawing Sheets

FLIP CHART SHEET RETAINER

BACKGROUND OF THE INVENTION

1. Field of the Invention

The present invention relates generally to the art of displaying charts and graphics and, more specifically, to a device for retaining pages on a flip chart.

2. Description of Related Art

The presentation of graphics and written materials for teaching and for business and other meetings has undergone considerable development in recent years. In the beginning there was the ubiquitous blackboard or slate. At one time the boards were actually black and were written on with sticks of chalk. Today, the board is more likely than not white or beige and is written on with special felt markers. In either case, the blackboard provides erasable information in a format that is large enough to be easily read by an audience and is presented interactively. That is, material is added or subtracted from the board as a lecturer speaks or in response to a question from the audience.

A major problem with all blackboard systems is their limited writing space. This means that sooner or later the speaker will erase part of the board and will be unable to refer again to that information. Also, it is very difficult to prepare a presentation in advance-one cannot bring in prepared sections of blackboard. One solution is an overhead projector which allows a speaker to draw or write as on a blackboard or use graphics prepared in advance to demonstrate more complex topics. The most recent advance to the overhead projector has been computer interfaces that can be placed on the overhead projector and display graphics generated by a MACINTOSH or other graphically-oriented computer system. However, all overhead projectors suffer from the shortcoming of being unable to show more than one image at a time.

A low tech alternative to the overhead projector is a flip chart. In its simplest form, the flip chart is merely a very large pad of paper. The lecturer uses felt markers or crayons to illustrate points. The flip chart is used like a blackboard, but the usual flip chart is not erasable. Instead, a new sheet of paper is revealed by tearing off the original sheet or by flipping it over the top of the pad. Thus, there is a need for a system that can easily accommodate an erasable board and a flip chart.

There are at least two advantages to the flip chart. First, it is quite simple to prepare much or all of the material in advance. Furthermore, the charts are usually small enough to be readily carried from place to place. Second, the chart is permanent so that sheets can be referred to repeatedly and even saved as a record of the presentation. One effective technique is to ask the audience questions as one writes on the chart. Audience consensus is then recorded on the chart. As ideas are developed, the key charts can be torn from the pad and taped or hung about the room so that they are always available for instant reference.

Once the charts are torn from the pad, there is a need for reassembling and holding a group of single sheets. A number of devices have been developed for this purpose. The most common way to use flip charts is on an easel-like structure that holds a pad of chart pages at a convenient height for audience viewing. Most often a clamp-like arrangement is provided to hold the pad. The clamp may be provided with teeth so that it can also grip and hold a limited number of loose sheets. Another solution is to provide flip chart sheets that are prepunched so they can be held by a device similar to a ring binder. A problem with ring binders is that they may open accidentally, causing the sheets to tumble out. Or the rings may be made too difficult to open easily in a misguided effort to prevent accidental opening.

OBJECTS AND SUMMARY OF THE INVENTION

It is an object of the present invention to provide an improved holder for flip chart sheets that allows sheets to be added or removed from a collection of sheets;

It is a further object of the present invention to provide a flip chart sheet holder that is easy to operate and yet will not open accidentally; and It is an additional object of the present invention to provide a flip chart sheet holder that can be removably added to a presentation board.

These and other objects are met by two or more flip chart sheet retaining rings attached to a mounting member which can be removably attached to a top edge surface of a presentation board. The sheet retaining rings are formed from a round cross-sectioned rod and are essentially flattened ovals shaped like a racetrack: straight middle portions joined by semicircular end portions. The rings are not closed; there is a gap in one of the straight middle portions of each ring. The gap, about one-half as long as the straight portion, is intended for the insertion of punched sheets into the ring.

A ring closure in the form of a straight hollow cylinder is provided for each ring. A diameter of the closure is slightly larger than that of the rod so that the rod end at the gap can be inserted into the closure. The closure is longer than the gap and is attached to the mounting member. A first end of the ring can be slid into a first end of the ring closure, with the straight middle portion of the ring sliding into the straight closure until sliding is stopped by a curved portion of the ring. At this point the gap will be visible at a second end of the closure. With the gap thus revealed, punched sheets can be loaded onto the ring. The ring is then slid in an opposite direction so that the gap is closed when a second end of the ring enters a second end of the ring closure. The ring is closed when the gap is concealed within the closure. A simple locking mechanism is provided that controls sliding of the ring and, hence, prevents accidental opening.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a flip chart sheet retainer system.

Figure 1:
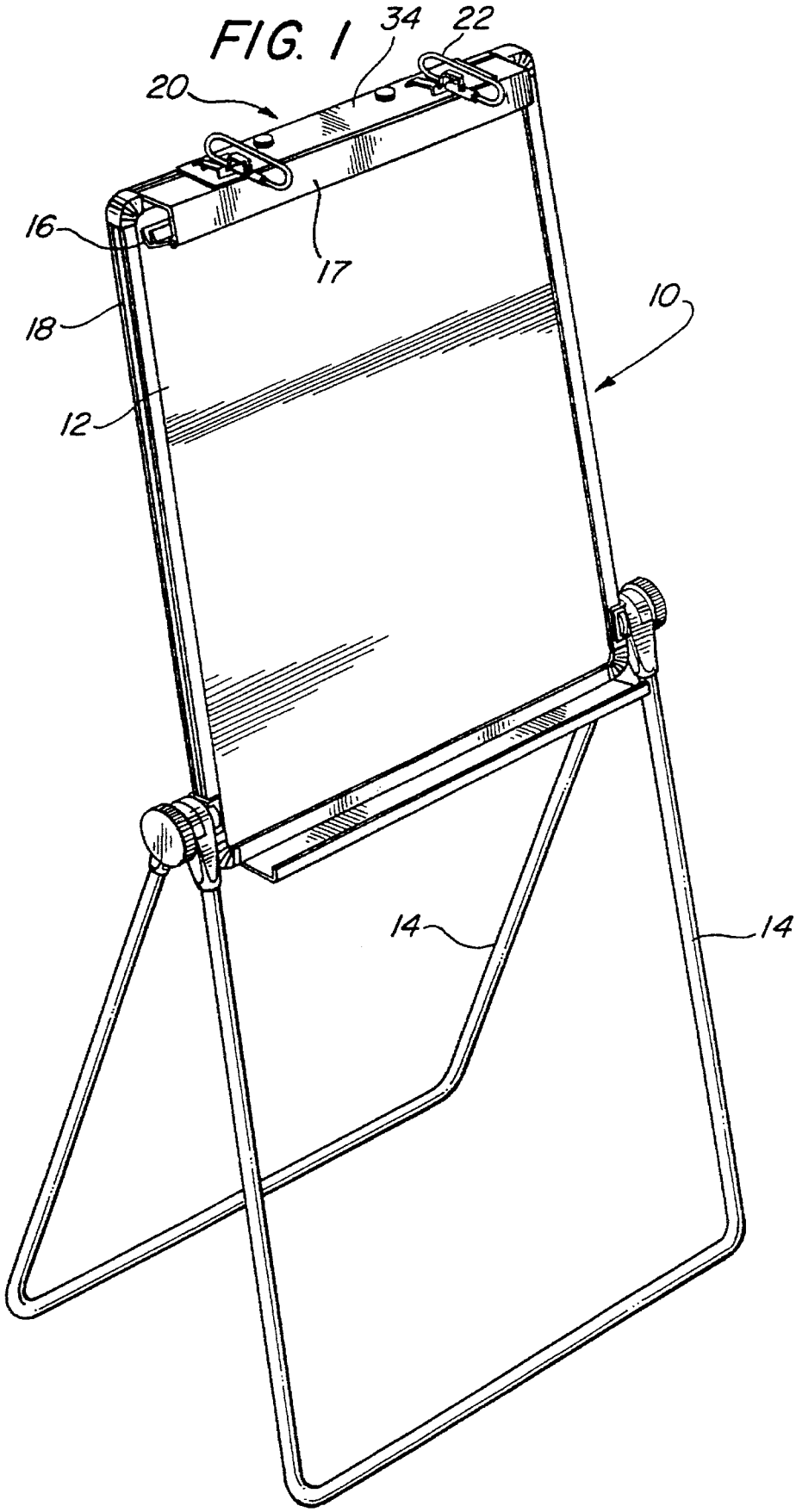
FIG. 1 shows a perspective view of the present invention attached to a presentation board.
Figure 2:
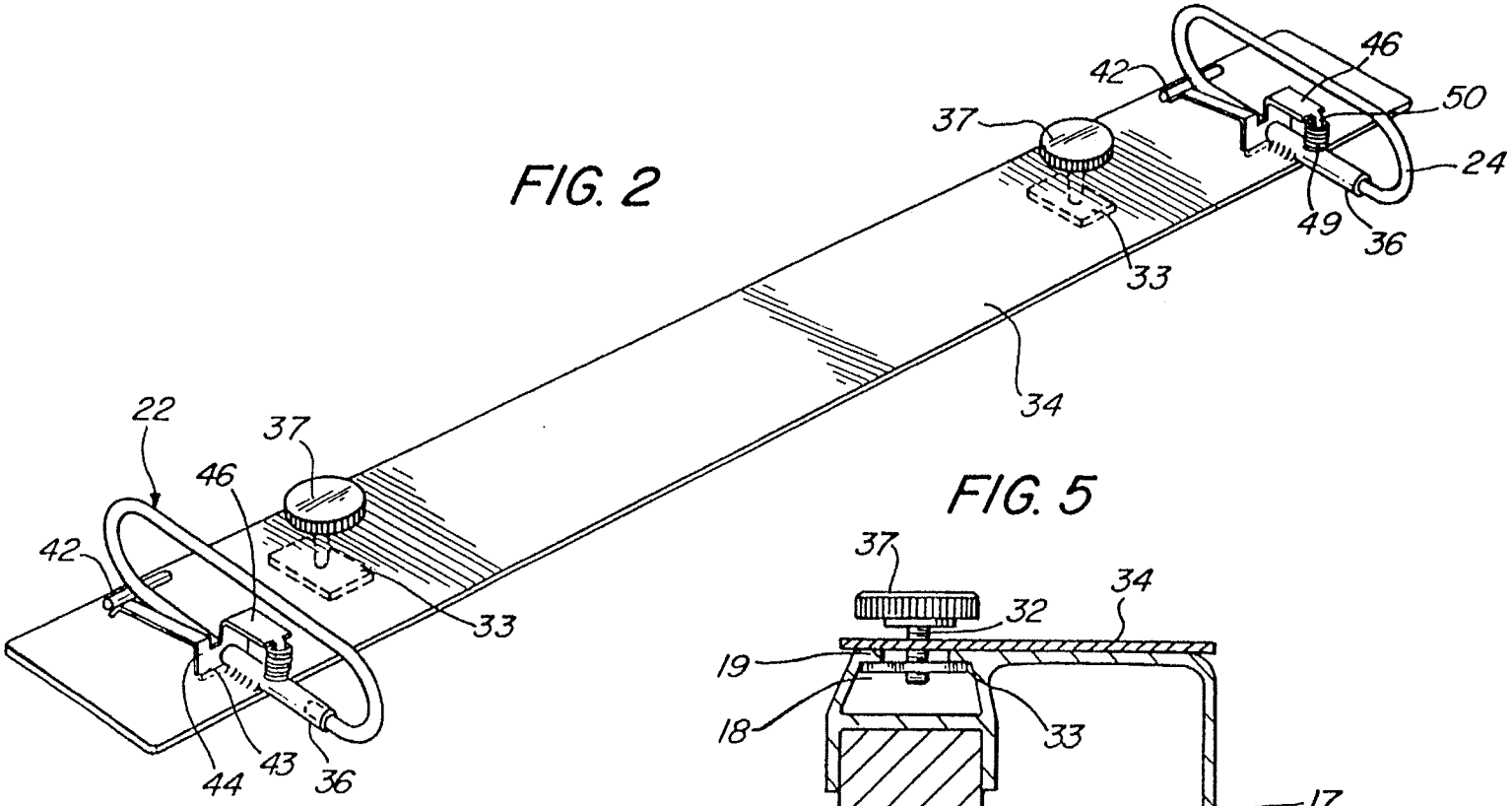
FIG. 2 shows a perspective view of the present invention.

In FIG. 1 the present invention 20 is shown attached to a presentation board 10. The present invention 20 is designed to be removably attached to the presentation board 10, which comprises an erasable white board 12 supported at a convenient height on legs 14. The presentation board 10 has a clamp system 16, 17 for holding single sheets, but does not normally have means to hold a plurality of flip chart sheets. The present invention 20 provides that ability in the form of sheet retainers 22 attached to a support member 34 which, in turn, can be removably attached to the presentation board 10.

Figure 5:
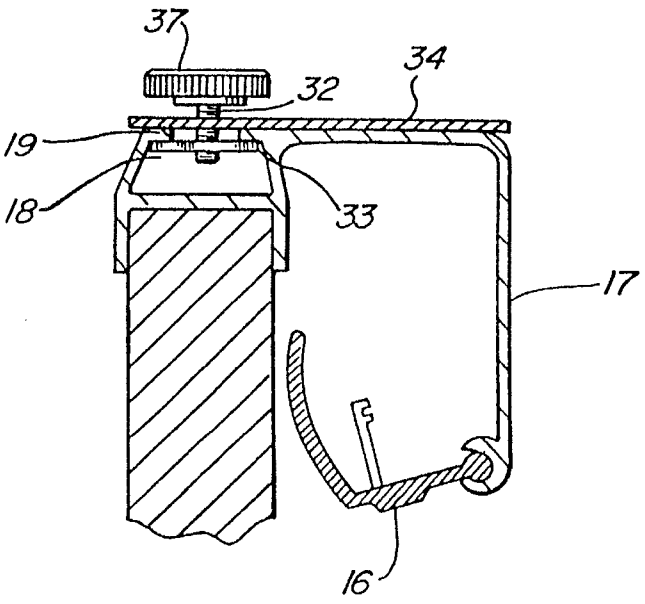
FIG. 5 shows a cross-section of the support member.
Figure 4:
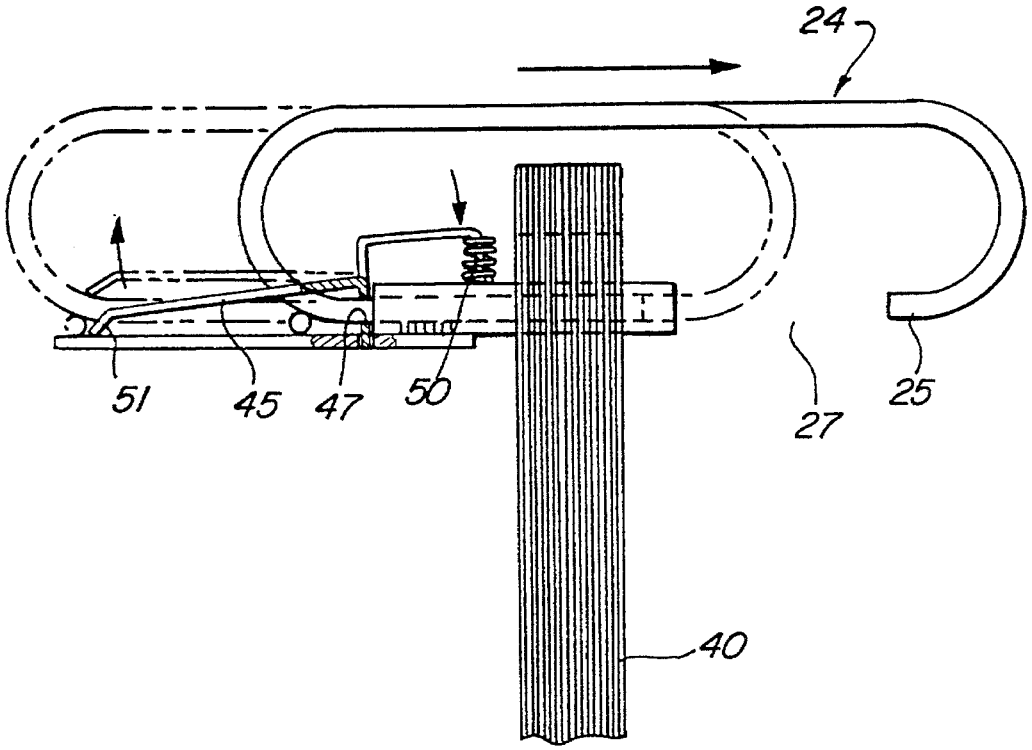
FIG. 4 shows a retainer ring of the present invention in an opened configuration.

As shown in FIG. 5, bolts 32 and oversized nuts 33 are provided for attachment to the presentation board 10. When the support member 34 is placed on the presentation board 10, the nuts 33 are inserted into a channel 18 that is slightly wider than a width of the nuts. The channel 18 has overhanging lips 19 so that if a knob 36 on an end of the bolt 32 opposite to the nut 33 is turned, the nut 33 rotates and becomes wedged under the lips 19. Additional turning of the knob 36 causes the bolt 32 to be engaged by the nut 33, thereby drawing down and fixing the support member 34 to the presentation board 10. The weight of the support member 34 is also supported by a projecting grip 17 which along with a rounded member 16 forms the clamping system for single sheets. Other mechanical fasteners such as studs with wing nuts are equally useable. In addition, the sheet retainers 22 of the present invention could be permanently attached to a top edge surface of the presentation board 10, thus obviating a need for the support member 34.

Figure 3:
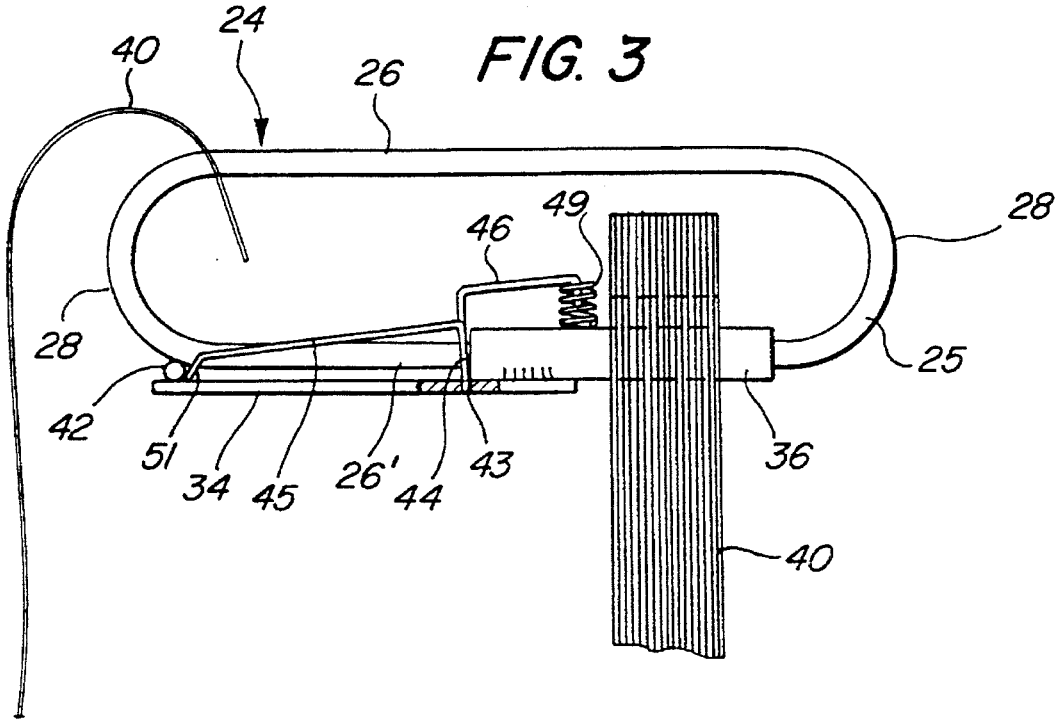
FIG. 3 shows a retainer ring of the present invention in a closed configuration.

The present invention 20 uses two identical sheet retainers 22. Although some applications may employ more than two sheet retainers. The sheet retainers 22 are essentially rings which can be opened to insert punched sheets and can then be closed to retain the sheets. The retained sheets may be punched sheets of paper or may actually be punched plastic sheaths which enclose and protect specially prepared presentation graphics. Each sheet retainer 22 actually comprises a ring 24 and a ring closure 36. FIG. 3 shows a ring member formed into the ring 24 of the preferred embodiment which has a flattened oval shape like that of a race track. The ring 24 has substantially parallel straight midportions 26 connected by semicircular end portions 28. The ring member 25 has a circular cross-section, although other cross-sectional shapes could be adapted to the present invention. The important point is that a diameter of the ring member 25 readily fits through punched holes on punched sheets 40 like those used in a flip chart. A round or oval cross-section is preferred because it has no sharp edges to damage the punched sheets 40. There is a gap 27 in one of the straight midportions 26' of the ring 24. The gap 27 extends from the end of the semicircular portion 28 to about a midpoint of the straight midportion 26' of the ring 24. Thus, the ring 24 has one nongapped straight portion 26 and one gapped straight portion 26'.

The ring closure 36 is a hollow cylinder of a diameter to fit over the straight midportion 26' of the gapped side of the ring 24. The closure 36 is somewhat longer than the gap 27. Once the closure 36 is in place on the midportion 26' of the gapped side of the ring 24, the ring 24 can be slid relative to the closure 36 to either open the gap 27 (semicircular end 28 of the gap 27 not contacting the closure 36) or to close the gap (both ends of the gap 27 inserted into the closure 36).

In the sheet retainer 22 the ring closure 36 is attached to an upper surface of the support member 34. The ring closure 36 is perpendicular to an edge of the member 34 and overhangs the edge so that it projects out from the face of the presentation board 10 when the support member 34 is attached to the board 10. The ring closures 36 are laterally spaced apart on the support member by a standard distance that equals the distance separating prepunched holes on a flip chart sheet or other material to be held by the ring. Thus, prepunched sheets 40 can be conveniently hung on the projecting closures 36.

The ring 24 is oriented perpendicular to the upper surface of the support member 34. This orientation is maintained by contact between a straight lock bar 42 and the upper surface. The lock bar 42 is oriented at right angles to a radius of the ring 24 and is attached to an outer edge of the ring member 25 at the juncture between the gapped straight midportion 26' and the semicircular portion 25 of the ring 24. The contact with the support member 34 forces the lock bar 42 to remain parallel to the upper surface of the support member 34 and, thus, keeps the ring 24 perpendicular to the surface.

The gapped straight portion 26' can be slid into the closure 36 exposing the gap 27 (opened position) or out of the closure 36 closing the gap 27 (closed position). The movement of the ring 24 is governed by a ring lock assembly located at an end of the ring closure 36 opposite an end of the closure 36 that projects over the edge of the support member 34. The ring lock assembly comprises a vertically-oriented ring lock 44 that engages the support member, a horizontally-oriented pressure surface 46, and a locking piece 45. The ring lock 44 bears a tab 43 by which it engages a slot on the surface of the support member 34. The tab 43 and slot fix the ring lock 44 in position, but leave it free to pivot in a direction perpendicular to a long axis of the support member 34. The ring 24 passes through a hole 47 in the ring lock 44. This hole is only slightly larger than the diameter of the ring member 25.

The horizontally-disposed pressure surface 46 is attached to an upper edge of the ring lock 44. A spring 49 is held between the pressure surface 46 and the ring closure 36 by a projection 50 descending from the pressure surface 46. The spring 49 biases the ring lock 44 so that it is normally pivoted away from the ring closure. The locking piece 45 is attached to the ring lock and comprises an elongate member substantially perpendicular to the ring lock 44 and pointing away from the ring closure 36. An end 51 of the locking piece 45 is angled to contact the upper surface of the support member 34 near the lock bar 42 when the ring 24 is in the closed position. The locking piece end 51 effectively blocks the lock bar 42 from moving towards the closure 36. Thus, the ring lock assembly keeps the ring 24 in the closed position. When the pressure surface 46 is pressed, the ring lock 44 pivots towards the ring closure 36. This lifts the connected locking piece 45 which frees the lock bar 42 so that the ring 24 can be slid to the opened position.

When the ring 24 is in the opened position, new punched sheets 40 can be hung on the projecting ring closure 36. After the ring 24 is returned to the closed position, the sheets 40 can be flipped behind the presentation board 10. A flipped sheet will travel up and over the nongapped side 26 of the ring 24 and end up hanging behind the presentation board 10. The straight midportion 26 of the ring provides a space for many sheets to accumulate.

If a large number of sheets 40 are being added to the opened rings 24 at one time, there may be too many sheets to fit on the projecting ring closures 36. Therefore, the sheets 40 may be threaded directly onto the ring 24 and flipped over to hang behind the presentation board 10. In this case, pressure may be exerted on the ring 24, causing it to slide towards the closed position, thereby disrupting the addition of sheets.

The ring lock assembly also serves to lock the ring in the opened position, thereby preventing accidental closure. When the ring 24 is slid into the opened position, the straight midportion 26' moves smoothly through the pivoted ring lock 44. When the ring 24 is fully in the opened position, the semicircular region 28 of the ring 24 contacts the ring lock 44. The curved portion cannot fit through the hole 47, so the ring lock 44 is forced into a more vertical position. Now the force of the spring 49 causes an edge of the hole 47 to contact and "bite into" the semicircular region 28. This pressure effectively locks the ring 24 in the opened position, thus avoiding accidental movement or closure. When the pressure piece 46 is pressed, causing the ring lock 44 to pivot farther, contact between the hole's edge and the semicircular region 28 is released and the ring 24 can again be easily slid.

The ring 24 of the present invention 20 has been described as a flattened oval. This is a preferred shape because it provides a large storage area for punched sheets 40, and because the straight midportion 26' slides readily through a straight ring closure 36. It is not necessary that the ring have two straight portions 26, 26'-only one straight region 26' is needed to slide through the straight ring closure 36. If other shapes are contemplated which do not contain a straight segment, some adaptations will be necessary. For example, substantially circular rings could be used, but the ring closure 36 would have to be arcuate. A curved ring closure would ensure that the ring remained perpendicular to the support member 34; however, the ring locking assembly would require some adaptation.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A device for removably retaining punched sheets of material for use on a flip chart or the like, the device comprising:

a substrate member, an elongate planar rectangle having a first and a second long edge;

means for removably attaching the substrate member to a support such as a presentation board; and at least two sheet retainers, each retainer comprising:

a ring closure, a hollow member sized to pass through a hole punched in a punched sheet of material, the closure fixed to an upper surface of the substrate member near the first long edge with a long axis of the closure substantially perpendicular to the edge and with a first end of the closure projecting beyond the edge so that the punched sheet can be hung on the projecting end;

a flattened oval ring formed from a ring member having a cross-section sized to fit into an open end of the closure, the ring having two substantially straight and parallel middle regions connected by two rounded, semicircular end regions, a first straight regions having a gap shorter in length than a length of the ring closure, an end of the ring member at the gap inserted into a second end of the ring closure so that the first straight middle region of the ring is slidingly moveable within the ring closure from an opened position which exposes the gap at the first end of the closure to a closed position which closes the gap;

a ring lock, vertically disposed at the second end of the closure, pivoting on the substrate member and fixed in place by the ring which passes slidingly through a hole in the ring lock, the hole sized to interact with the ring and lock it in the opened position until the ring lock is pivoted;

a receiving surface connected to the ring lock for receiving force, whereupon the lock pivots;

a locking piece attached to the ring lock so that the locking piece is moved from a rest position when the receiving surface receives force, thereby pivoting the lock;

a spring to bias the ring lock so that the locking piece is held in the rest position; and a lock bar attached to the ring and interacting with the lock piece in the rest position to prevent the ring from being moved to the opened position, and also interacting with the substrate member to maintain the ring at right angles to the upper surface of the member.

2. A sheet retaining ring assembly for removably retaining punched sheets of material comprising:

a ring formed from a ring member having a cross-section sized to fit a hole punched in a sheet of material, the ring forming a closed figure except for a gap in the ring, the gap defining a first end and a second end of the ring member;

a ring closure, a hollow member longer than the gap in the ring, and sized and shaped to accept the first end of the ring member and to allow a portion of the ring to slide into a first end of the closure so that the ring can be moved between an opened position with the gap revealed at a second end of the closure and a closed position with the second end of the ring member inserted into the second end of the closure, the closure fixed to an upper surface of a substrate member near an edge of the substrate member with a long axis of the closure substantially perpendicular to the edge and with the second end of the closure projecting beyond the edge so that the punched sheet can be hung on the projecting end;

locking means for locking the ring in the closed position until the locking means are released;

stopping means for stopping the ring in the opened position until the stopping means are released;

blocking means for blocking the ring from moving beyond the opened position and beyond the closed position; and releasing means for releasing the locking and stopping means.

3. The assembly of claim 2, wherein the locking means comprises a lock bar, a projection attached to the ring, and a lock piece positioned to interact with the lock bar and prevent movement of the ring.

4. The assembly of claim 2, wherein the stopping means comprises a ring lock bearing a hole through which the ring is slidingly moveable until the opened position is reached, whereupon the ring lock engages the ring preventing further movement.

5. The assembly of claim 2, wherein the blocking means comprises an interaction between the first end of the ring closure and the ring, the interaction preventing a region of the ring from sliding into the second end of the closure.

6. The assembly of claim 2, wherein the releasing means comprises a pivotable member, the member pivoting to end an interaction between a lock piece and a lock bar and an engagement between a ring lock and the ring.

7. A device for removably retaining punched sheets of material used for writing and display with a flip chart and the like, the device comprising:

a substrate member being an elongate planar rectangle with a first and a second long edge;

bolts for removably securing the substrate member to a support such as a presentation board, the bolts disposed to pass through holes in the substrate member, upper ends of the bolts being retained by handles and lower ends engaging rectangular nuts sized to be engaged by a channel in the presentation board; and at least two sheet retainers attached to the substrate member, each retainer comprising:

a ring closure, a hollow cylinder sized to pass through a hole punched in a punched sheet of material, the closure attached to an upper surface of a substrate member near the first long edge of the member with a long axis of the closure substantially perpendicular to the long edge and with a first end of the closure projecting beyond the first long edge so that the punched sheet can be hung on the projecting end;

a flattened oval ring formed from a ring member having a circular cross-section sized to fit both the hole in the punched sheet and an open end of the closure, the ring having two substantially straight and parallel middle regions connected by two rounded, semicircular end regions, a first straight regions having a gap shorter in length than a length of the ring closure, an end of the ring member at the gap inserted into a second end of the ring closure so that the first straight middle region of the ring is slidingly moveable within the ring closure from an opened position which exposes the gap at the first end of the closure to a closed position which closes the gap;

a ring lock, vertically disposed at the second end of the closure, pivoting on a descending tab inserted into a slot in the substrate member and fixed in place by the ring which passes slidingly through a round hole in the ring lock, the hole sized to interact with the ring and lock it in the opened position until the ring lock is pivoted;

a horizontally-disposed pressure surface attached to the ring lock for receiving pressure from a finger or the like, the pressure causing the lock to pivot;

a locking piece attached to the ring lock so that the locking piece is raised when the pressure surface is pressed, thereby pivoting the lock;

a spring to bias the ring lock so that the locking piece is held in a lowered position; and a lock bar attached to the ring and interacting with the lowered lock piece to prevent the ring from being moved to the opened position, and also interacting with the substrate member to maintain the ring at right angles to the upper surface of the member.

8. An apparatus for displaying written information for meetings and presentation comprising:

a substantially rectangular erasable writing surface;

legs, adjustably attached to the writing surface, for supporting the writing surface in a nearly vertical orientation;

an elongate frame member attached to and covering at least an upper edge of the surface, the frame member having a longitudinally-arranged channel with overhanging edges;

a substrate member for carrying a sheet retainer system and attaching the system to the upper edge frame member of the writing surface, the substrate member being an elongate planar rectangle with a first and a second long edge;

bolts for removably securing the substrate member to the frame member, the bolts disposed to pass through holes in the substrate member, upper ends of the bolts being retained by handles;

rectangular nuts engaging lower end of the bolts and sized to interact with the overhanging edges of the channel in the frame member; and at least two sheet retainers attached to the substrate member, each retainer comprising:

a ring closure, a hollow cylinder sized to pass through a hole punched in a sheet of material, the closure fixed to an upper surface of a substrate member near the first long edge of the member with a long axis of the closure substantially perpendicular to the long edge and with a first end of the closure projecting beyond the edge so that the punched sheet can be hung on the projecting end;

a flattened oval ring formed from a ring member with a circular cross-section sized to fit both the hole in the punched sheet and an end of the closure, the ring having two substantially straight and parallel middle regions connected by two rounded, semicircular end regions, a first straight region having a gap shorter in length than a length of the ring closure, an end of the ring member at the gap inserted into a second end of the ring closure so that the first straight middle region of the ring is slidingly moveable within the ring closure from an opened position which exposes the gap at the first end of the closure to a closed position which conceals the gap;

a ring lock, vertically disposed at the second end of the closure, pivoting on a descending tab inserted into a slot in the substrate member and fixed in place by the ring which passes slidingly through a round hole in the ring lock, the hole sized to interact with the ring and lock it in the opened position until the ring lock is pivoted;

horizontally-disposed pressure surface attached to the ring lock for receiving pressure from a finger or the like, the pressure causing the lock to pivot;

a locking piece attached to the ring lock so that the locking piece is raised when the pressure surface is pressed to pivot the ring lock;

a spring to bias the ring lock so that the locking piece is held in a lowered position; and a lock bar attached to the ring and interacting with the lowered lock piece to prevent the ring from being moved to the opened position, and also interacting with the substrate member to maintain the ring at right angles to the upper surface of the substrate member.

9. A sheet retaining ring assembly for removably retaining punched sheets of material comprising:

a ring closure, a hollow member sized to pass through a hole punched in a punched sheet of material, the closure attached to an upper surface of a substrate member near a first edge thereof with a long axis of the closure substantially perpendicular to the first edge and with a first end of the closure projecting beyond the first edge so that the punched sheets can be hung on the projecting end;

a flattened oval ring formed from a ring member having a cross-section sized to fit into an open end of the closure, the ring having two substantially straight and parallel middle regions connected by two rounded, semicircular end regions, a first straight middle region having a gap shorter in length than a length of the ring closure, an end of the ring member at the gap inserted into a second end of the ring closure so that the first straight middle region of the ring is slidingly moveable within the ring closure from an opened position which exposes the gap at the first end of the closure to a closed position which conceals the gap;

a ring lock, vertically disposed at the second end of the closure, pivoting on the substrate member and fixed in place by the ring which passes slidingly through a hole in the ring lock, the hole sized to interact with the ring and lock it in the opened position until the ring lock is pivoted;

a receiving surface connected to the ring lock for receiving force, whereupon the lock pivots;

a locking piece attached to the ring lock so that the locking piece is moved from a rest position when the receiving surface receives force which pivots the ring lock;

a spring to bias the ring lock so that the locking piece is held in the rest position; and a lock bar attached to the ring and interacting with the locking piece in the rest position to prevent the ring from being moved to the opened position, and also interacting with the substrate member to maintain the ring at right angles to the upper surface of the member.

10. A device for removably retaining punched sheets of material used on a flip chart or the like, the device comprising:

a substrate member;

means for attaching the substrate member to a support such as a presentation board; and at least two sheet retainers, each retainer comprising:

a ring formed from a ring member having a cross-section sized to fit a hole punched in a sheet of material; the ring forming a closed figure except for a gap in the ring, the gap defining a first end and a second end of the ring member;

a ring closure, a hollow member longer than the gap in the ring, and sized and shaped to accept the first end of the ring and to allow a portion of the ring to slide into a first end of the closure so that the ring can be moved between an opened position with the gap revealed at a second end of the closure and a closed position with the second end of the ring inserted into the second end of the closure, the closure fixed to an upper surface of the substrate member near an edge of the substrate member with a long axis of the closure substantially perpendicular to the edge and with the second end of the closure projecting beyond the edge so that the punched sheet can be hung on the projecting end;

locking means for locking the ring in the closed position until the locking means are released;

stopping means for stopping the ring in the opened position until the stopping means are released;

blocking means for blocking the ring from moving beyond the opened position and beyond the closed position; and releasing means for releasing the locking and stopping means.

11. The device of claim 10, wherein the locking means comprises a lock bar, a projection attached to the ring, and a lock piece positioned to interact with the lock bar, thereby preventing movement of the ring.

12. The device of claim 11, wherein the stopping means comprises a ring lock bearing a hole through which the ring is slidingly moveable until the opened position is reached, whereupon the ring lock engages the ring preventing further movement.

13. The device of claim 10, wherein the blocking means comprises an interaction between the first end of the ring closure and the ring, the interaction preventing a region of the ring from sliding into the first end of the closure, and wherein the blocking means also comprises an interaction between the second end of the ring closure and the ring, the interaction preventing a region of the ring from sliding into the second end of the closure.

14. The device of claim 12, wherein the releasing means comprises a pivotable member, the member pivoting to end the interaction between the lock piece and the lock bar and the engagement between the ring lock and the ring.

* * * * *